US005419722A

United States Patent [19]

Onoda

[11] Patent Number: 5,419,722

[45] Date of Patent: May 30, 1995

[54] SHIELD CONNECTOR

[75] Inventor: Katsuhiko Onoda, Shizuoka, Japan

[73] Assignee: Yazaki Corporation, Tokyo, Japan

[21] Appl. No.: 166,951

[22] Filed: Dec. 15, 1993

[30] Foreign Application Priority Data

Dec. 16, 1992 [JP] Japan ..... 4-086369 U

[51] Int. Cl.[6] ..... H01R 13/436

[52] U.S. Cl. ..... 439/752

[58] Field of Search ..... 439/595, 752

[56] References Cited

U.S. PATENT DOCUMENTS

| | | | |
|---|---|---|---|
| 4,998,896 | 3/1991 | Lundergan | 439/595 |
| 5,071,369 | 12/1991 | Denlinger et al. | 439/595 |
| 5,108,309 | 4/1992 | Oda et al. | 439/595 |
| 5,176,537 | 1/1993 | Samejima et al. | 439/595 |

FOREIGN PATENT DOCUMENTS

| | | |
|---|---|---|
| 58-198879 | 11/1983 | Japan . |
| 61-157280 | 9/1986 | Japan . |
| 4-27579 | 3/1992 | Japan . |

*Primary Examiner*—Gary F. Paumen

*Attorney, Agent, or Firm*—Sughrue, Mion, Zinn, Macpeak & Seas

[57] ABSTRACT

A shield connector including an electrically-conductive shield cover mounted on an outside of an insulative housing to cover the housing. An elastic retaining portion for retaining a terminal is formed on and projects from an inner surface of the insulative housing and a projection portion for insertion into a space formed on a back side of the elastic retaining portion is formed on the electrically-conductive shield cover. During assembly, the terminal is inserted into the insulative housing, while flexing the elastic retaining portion. Simultaneously to when the electrically-conductive shield cover is attached, the projection portion is inserted into the space provided on the back side of the elastic retaining portion. The projection portion prevents the flexing of the elastic retaining portion, thereby preventing withdrawal of the terminal.

12 Claims, 6 Drawing Sheets

SHIELD CONNECTOR

BACKGROUND OF THE INVENTION

1. Field of the Invention

This invention relates to a shield connector capable of effecting a double lock of a terminal.

2. Background

FIG. 7 is an exploded perspective view of a shield connector disclosed in U.S. Ser. No. 08/021,119, filed by the same inventor of the present invention.

This shield connector 70 comprises an insulative housing 72 made of a synthetic resin for receiving terminals 71, a terminal retainer 73 made of a synthetic resin inserted into the insulative housing 72, and electrically-conductive shield cover halves 74 and 75 which are secured to each other to surround the housing.

The terminal retainer 73 has terminal insertion holes 76, retaining projections 78 for engaging with an edge 77 of an opening in the insulative housing 72, and an abutment portion 80 against which the rear stepped portions 79 of the terminals 71 abut when in the completely retained position. The retainer is initially retained in a provisional position on the housing 72 at which the terminals 71 are inserted. Thereafter, the retainer is moved to the completely retained position at which the abutment portion 80 is positioned against the rear step portions 79 of the terminals 71, thereby preventing the terminals 71 from being withdrawn rearwardly. The terminal 71 is locked in a double manner by the retainer 73 and a remaining lance (not shown) provided within the housing 72.

Each of the electrically-conductive cover halves 74 and 75 is formed by applying an electrically-conductive plating to a surface of a synthetic resin material and is grounded to a contact member 82 fixedly connected to an end portion of a shield wire 81, thereby shielding the entire connector.

In the above-mentioned construction, however, in order to effect a double lock of the terminal, the separate retainer 73 must be provided, resulting in an increase in the number of the component parts. Therefore, the cost and assembly time are increased and inventory is more difficult.

SUMMARY OF THE INVENTION

With the above problems in mind, it is an object of this invention to provide a shield connector which is capable of effecting a double lock of terminals without the use of a retainer, and is advantageous from the viewpoints of cost, inventory and assembly efficiency.

According to the present invention, there is provided a shield connector including an electrically-conductive shield cover mounted on an outside of an insulative housing to cover the housing. According to the invention, an elastic retaining portion for retaining a terminal is formed on and projects from an inner surface of the insulative housing and a projection portion, for insertion into a space formed on a back side of the elastic retaining portion, is formed on the electrically-conductive shield cover.

The terminal is inserted into the insulative housing, while flexing the elastic retaining portion inwardly. Simultaneously to when the electrically-conductive shield cover is attached to the housing, the projection portion is inserted into the space provided on the back side of the elastic retaining portion. The projection portion prevents the flexing of the elastic retaining portion, thereby preventing withdrawal of the terminal. Using the elastic retaining portion in combination with a retaining lance in the housing, a double lock of the terminal is achieved.

DESCRIPTION OF THE PREFERRED EMBODIMENTS

Figure 1:
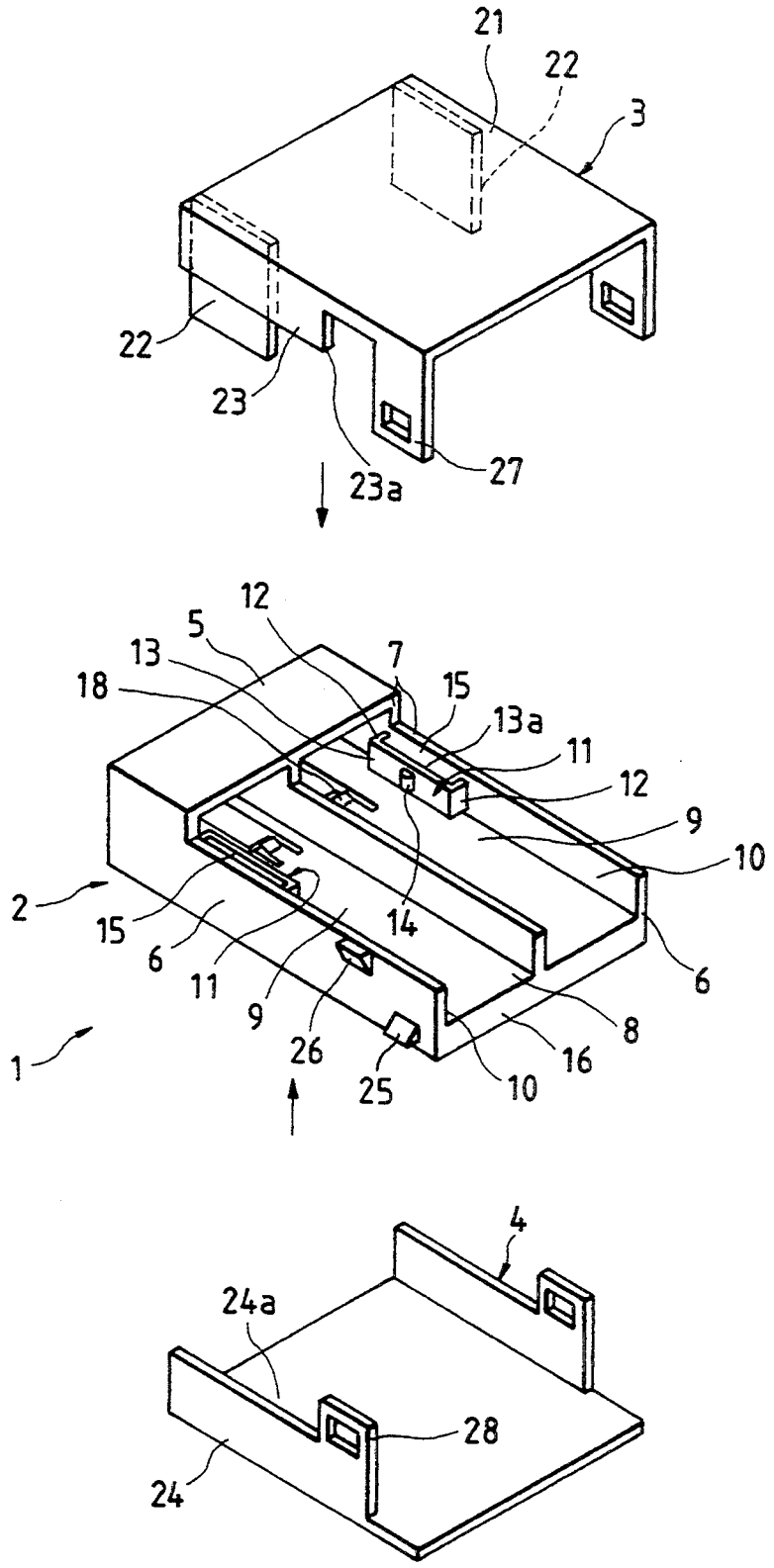
FIG. 1 is an exploded perspective view of a first embodiment of a shield connector of the present invention.
Figure 2:
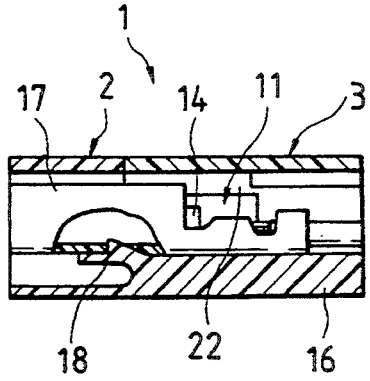
FIG. 2 is a vertical cross-sectional view of an important portion of the connector in an assembled condition.

FIG. 1 is an exploded perspective view of a first embodiment of a shield connector of the present invention, and FIG. 2 is a vertical cross-sectional view of an important portion of the connector in an assembled condition.

The shield connector 1 comprises an insulative housing 2 made of a synthetic resin for receiving terminals and an electrically-conductive shield cover defined by an upper cover 3 and a lower cover 4 which cooperates to surround the insulative housing 2. Each of the electrically-conductive shield covers 3 and 4 is formed by applying an electrically-conductive plating to a synthetic resin material as is the shield cover of the connector discussed in the Background section.

The insulative housing 2 has an opening 7 formed in a top wall 5 and opposite side walls 6 and 6, and the upper cover 3 is attached in confronting relation to the opening 7 so as to cover the opening. Right and left receiving chambers 9 and 9 are provided in the opening 7, and are separated from each other by a central partition wall 8. Elastic retaining portions 11 and 11 having a U-shape are respectively formed on and project from the inner surfaces 10 of outer walls of the receiving chambers 9.

Each of the elastic retaining portions 11 comprises a pair of front and rear support walls 12 and 12 extending from the inner surface 10, an elastic wall 13 interconnecting the two support walls 12 and 12, and a retaining projection 14 formed on a surface of the elastic wall 13. A space 15 for allowing flexing of the elastic wall 13 is provided between a back surface 13*a* of the elastic wall 13 and the inner surface 10.

Figure 3A:
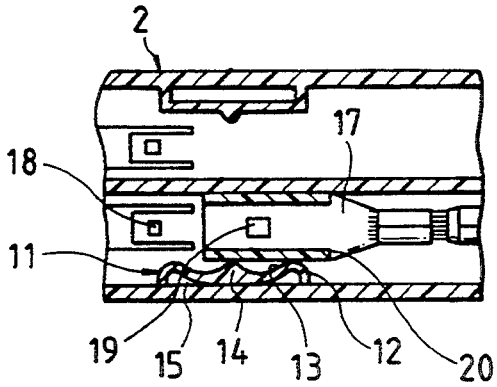
FIGS. 3(*a*) and 3(*b*) are horizontal cross-sectional views of the connector, showing a retained condition of a terminal.
Figure 3B:
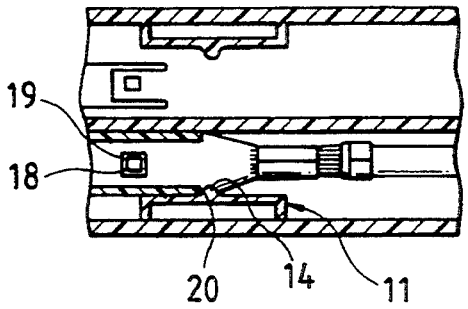

Retaining lances 18 are formed integrally on a bottom wall 16 of the receiving chambers 9. Each retaining lance cooperates with an associated elastic retaining portion 11 to effect a double lock of the terminal 17. As shown in FIGS. 3(*a*) and 3(*b*), the terminal 17 advances while flexing the elastic retaining portion 11 outwardly until the retaining lance 18 engages a retaining hole 19 of the terminal, and at the same time, the projection 14 of the restored elastic retaining portion 11 abuts against a rear step portion 20 of the terminal.

Projection plates 22 project downwardly from an inner surface of a top wall 21 of the upper cover 3. The projection plates 22 are respectively inserted into the flexing spaces 15 simultaneously when the upper cover 3 is attached, thereby preventing further flexing of the elastic walls 13 so that the terminal is positively retained. The bottom edges 23*a* of opposite side walls 23 of the upper cover 3 are abutted against the top edges 24*a* of opposite side walls 24 of the lower cover 4, respectively. Additionally, retaining frame portions 27 and 28 are formed on rear portions of the side walls 23 and 24, respectively, and are respectively engaged with retaining projections 25 and 26 formed on the opposite side walls 6 of the housing 2. The retaining projection 25 is spaced from the retaining projection 26 along the length of the side wall 6 as shown.

Figure 4:
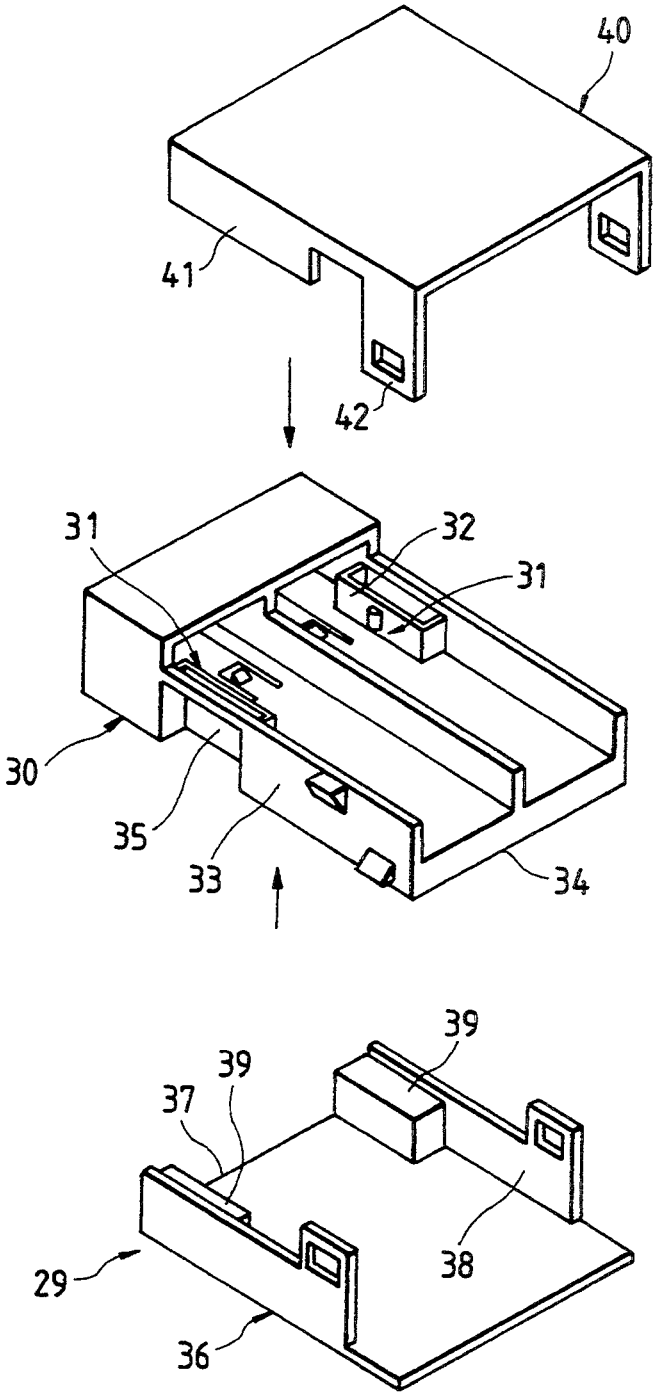
FIG. 4 is an exploded perspective view of a second embodiment of a shield connector of the present invention.

FIG. 4 is an exploded perspective view of a second embodiment of a shield connector of the present invention.

As in the above first embodiment, the shield connector 29 has elastic retaining portions 31 provided within an insulating housing 30. A rectangular space 35 is formed on an exterior side of an elastic wall 32 of each elastic retaining portion 31 in such a manner that it opens toward an outer surface of a side wall 33 of the housing 30, and is also open to an outer surface of a bottom wall 34 of the housing 30. A lower electrically-conductive cover 36 has projection blocks 39 which are respectively insertable into the spaces 35, each of the projection blocks 39 being formed on a bottom wall 37 and an inner surface of a respective one of the opposite side walls 38. The projection blocks 39 are inserted respectively into the spaces 35 simultaneously when the lower cover 36 is attached, thereby preventing the flexing of the elastic walls 32. An electrically-conductive upper cover 40 has only opposite side walls 41 and retaining frames 42 formed thereon.

Figure 5:
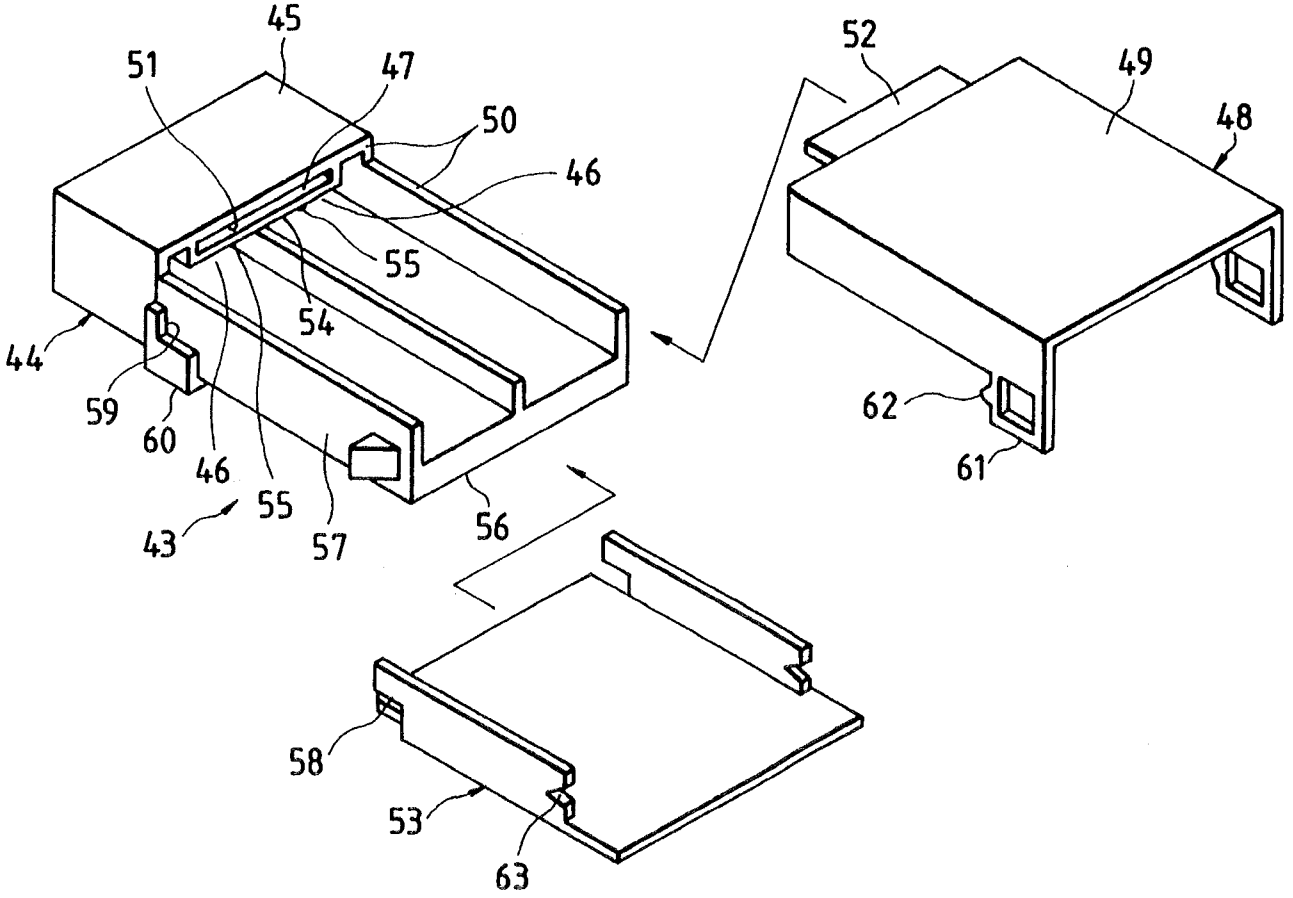
FIG. 5 is an exploded perspective view of a third embodiment of a shield connector of the present invention.
Figure 6A:
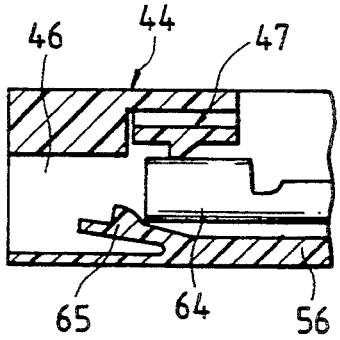
FIGS. 6(*a*) to 6(*c*) are vertical cross-sectional views of an important portion of the connector of FIG. 5, showing a retained condition of a terminal, and more specifically showing a terminal inserted condition, an engaged condition, and a cover-attached condition, respectively.
Figure 6B:
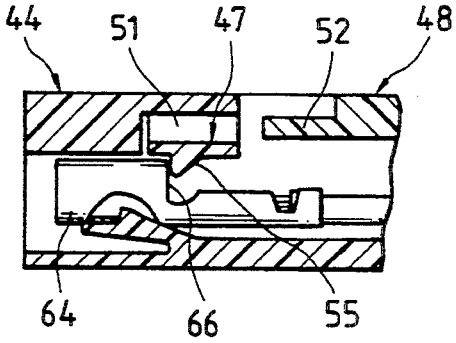
Figure 6C:
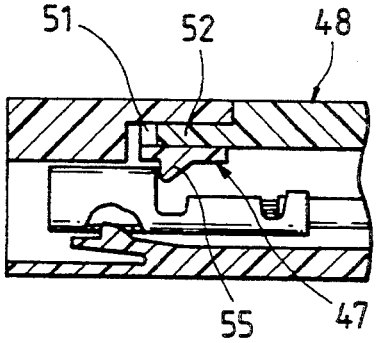
Figure 7:
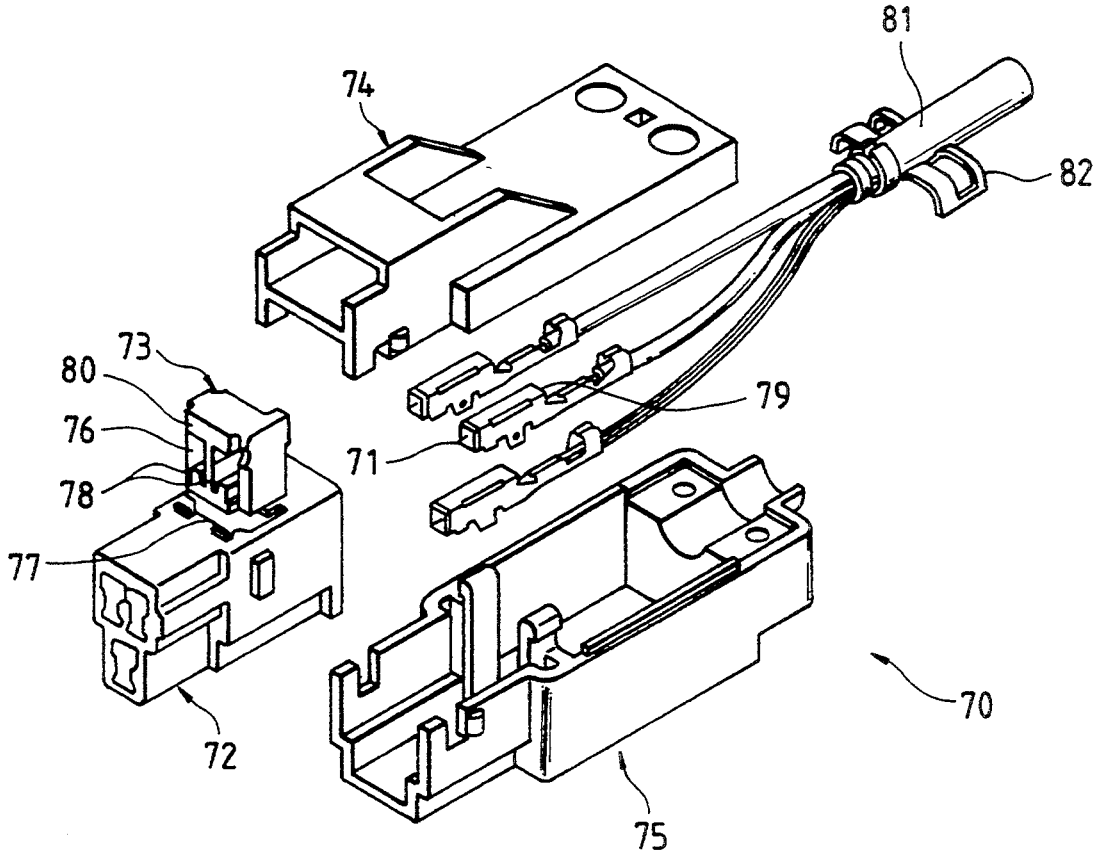
FIG. 7 is an exploded perspective view of a shield connector disclosed in a related application.

FIG. 5 is an exploded perspective view of a third embodiment of a shield connector of the present invention, and FIGS. 6(*a*) to 6(*c*) are vertical cross-sectional views of an important portion of this connector, showing an assembling operation.

In this shield connector 43, an elastic retaining portion 47 similar to that of the preceding embodiments is formed on and projects from a top wall 45 of an insulative housing 44 in such a manner that it faces terminal receiving chambers 46. A projection plate 52 is formed on a front end of a top wall 49 of an electrically-conductive upper cover 48, and is insertable into a space 51, formed on a back side of the elastic retaining portion 47, from an opening 50 in the housing 44.

In more detail, the projection plate 52 is disposed at a level lower than the surface of the top wall 49, and the upper cover 48 and a lower cover 53 are slidingly attached to the housing 44 from a rear side toward a front side. A pair of retaining projections 55 and 55 are formed on an elastic wall 54 of the elastic retaining portion 47, and are disposed in facing relation to the right and left terminal receiving chambers 46 and 46, respectively. A frame portion 60 is formed on a bottom wall 56 of the housing 44 and each of opposite side walls 57, and has an engagement step portion 59 for engagement with a notch 58 formed in the front end portion of the lower electrically-conductive cover 53. An engagement groove 63 is formed in a rear end of each of opposite side walls of the lower cover 53, and is engageable with a projection 62 formed on a respective one of engagement frames 61 formed on the upper cover 48.

As shown in FIGS. 6(*a*) to 6(*c*), a terminal 64 is introduced into the receiving chamber 46, and at this time the terminal 64 flexes the elastic retaining portion 47 upwardly and a retaining lance 65 formed on the bottom wall 56 downwardly. After the terminal is completely inserted, the projection 55 of the restored elastic retaining portion 47 retainingly engages a rear step portion 66 of the terminal 64. The elastic retaining portion 47 is prevented from further flexing as a result of the projection plate 52 being inserted into the space 51 simultaneously to when the upper cover 48 is attached, thereby achieving a double lock. In this embodiment, an electrically-conductive shield cover (not shown) of a tubular shape having a rectangular cross-section may be used instead of the two piece covers discussed above.

As described above, in the present invention, when the electrically-conductive shield cover is attached, the projection portion is inserted into the space on the back side of the elastic retaining portion, thereby preventing the rearward withdrawal of the terminal. Therefore, the man hours required for retaining the terminal is eliminated, and the cost of the retainer, as well as the management of its inventory is reduced. Furthermore, the retaining portion remains positively engaged with the terminal and cooperates with the retaining lance in the housing to positively lock the terminal in a double manner.

What is claimed is:

1. A shield connector, comprising:

an insulative housing having at least one terminal receiving chamber therein for receiving a terminal;

an elastic retaining portion, for retaining a terminal, projecting into said terminal receiving chamber from an inner surface of said insulative housing, said retaining portion being deflected into a receiving space as the terminal is inserted into the terminal receiving chamber;

a cover for covering said housing; and a projecting portion extending from said cover and being insertable into said receiving space, wherein after the terminal has been completely inserted into the terminal receiving chamber, said projecting portion is inserted into said receiving space so as to prevent subsequent deflection of said retaining projection and removal of the terminal, and wherein said cover includes top and bottom half covers and locking means for locking said half covers to each other.

2. The shield connector of claim 1, wherein said retaining portion extends from a side wall of said housing which partially defines the terminal receiving chamber.

3. The shield connector of claim 1, further comprising a retaining lance extending from said housing into the terminal receiving chamber for retaining the terminal therein, said retaining portion and said retaining lance cooperating to retain the terminal in a dual manner.

4. The shield connector of claim 1, wherein said receiving space is defined between said inner surface and said retaining portion.

5. The shield connector of claim 1, wherein said receiving space is disposed on the exterior of said housing.

6. The shield connector of claim 1, wherein said retaining portion extends from an upper surface of said housing.

7. The shield connector of claim 6, wherein said retaining portion comprises:

a pair of support walls extending from said upper surface;

an elastic wall interconnecting a distal end of said pair of support walls, said receiving space being defined by said support walls, said elastic wall and said upper surface; and a retaining projection projecting from said elastic wall into the terminal receiving chamber.

8. The shield connector of claim 7, wherein said projecting portion extends in a direction of insertion of the terminal receiving chamber.

9. A shield connector comprising:

an insulative housing having at least one terminal receiving chamber therein for receiving a terminal;

an elastic retaining portion, for retaining a terminal, projecting into said terminal receiving chamber from an inner surface of said insulative housing, said retaining portion being deflected into a receiving space as the terminal is inserted into the terminal receiving chamber;

a cover for covering said housing; and a projecting portion extending from said cover and being insertable into said receiving space, wherein after the terminal has been completely inserted into the terminal receiving chamber, said projecting portion is inserted into said receiving space so as to prevent subsequent deflection of said retaining projection and removal of the terminal, wherein said retaining portion comprises a pair of support walls extending from said inner surface; an elastic wall interconnecting a distal end of said pair of support walls, said receiving space being defined by said support walls, said elastic wall and said inner surface; and a retaining projection projecting from said elastic wall into the terminal receiving chamber.

10. The shield connector of claim 9, wherein said retaining portion extends from a side wall of said housing which partially defines the terminal receiving chamber.

11. The shield connector of claim 9, further comprising a retaining lance extending from said housing into the terminal receiving chamber for retaining the terminal therein, said retaining portion and said retaining lance cooperating to retain the terminal in a dual manner.

12. The shield connector of claim 9, wherein said receiving space is defined between said inner surface and said retaining portion.

* * * * *